US006729222B2

(12) United States Patent
McNulty, Jr.

(10) Patent No.: US 6,729,222 B2
(45) Date of Patent: May 4, 2004

(54) DART PROPULSION SYSTEM FOR AN ELECTRICAL DISCHARGE WEAPON

(76) Inventor: James F. McNulty, Jr., 1290 Third St., Calimesa, CA (US) 92320

( * ) Notice: Subject to any disclaimer, the term of this patent is extended or adjusted under 35 U.S.C. 154(b) by 0 days.

(21) Appl. No.: 10/253,386

(22) Filed: Sep. 24, 2002

(65) Prior Publication Data

US 2003/0010184 A1 Jan. 16, 2003

Related U.S. Application Data

(63) Continuation-in-part of application No. 09/826,161, filed on Apr. 3, 2001, now Pat. No. 6,477,933.

(51) Int. Cl.[7] ..... F41B 7/00

(52) U.S. Cl. ..... 89/1.34; 124/20.3; 124/22; 124/36

(58) Field of Search ..... 89/1.34; 124/20.3, 124/21, 22, 36, 32; 102/357, 702

(56) References Cited

U.S. PATENT DOCUMENTS 3,803,463 A 4/1974 Cover
5,020,437 A * 6/1991 Rieger et al. ..... 102/489
5,033,446 A * 7/1991 Bradt ..... 124/26
5,078,117 A 1/1992 Cover
5,167,902 A * 12/1992 McCray et al. ..... 266/45
5,654,867 A 8/1997 Murray
5,786,546 A * 7/1998 Simson ..... 102/438
5,996,504 A * 12/1999 Lowery ..... 102/504
6,477,933 B1 * 11/2002 McNulty, Jr. et al. ..... 89/1.34

* cited by examiner

*Primary Examiner*—Stephen M. Johnson
(74) *Attorney, Agent, or Firm*—Leonard Tachner

(57) ABSTRACT

A wire-tethered dart cartridge for electrical discharge weapons or stun guns wherein the sudden force needed to propel the darts toward a remote target is derived from a source of energy other than expanding gas. The propulsive force is derived from potential energy stored in at least one coiled spring having an arm which impacts the dart with sufficient force to propel the dart a desired distance toward a remote target. In a preferred embodiment disclosed herein, the spring is formed on two interconnected coils, each end of the spring wire extending from a respective coil and forming an impact arm for striking the back of a dart. The arms are maintained in a tensioned configuration by retention pistons which are connected to pyrotechnic devices. When an electrical voltage is applied to the pyrotechnic devices, the ignition forces each piston to move suddenly to release the arms. The potential energy in the springs then forces the arms to rotate around their respective coils at high speed and impact the respective darts.

6 Claims, 10 Drawing Sheets

DART PROPULSION SYSTEM FOR AN ELECTRICAL DISCHARGE WEAPON

RELATION TO CORRESPONDING APPLICATIONS

This application is a continuation-in-part of patent application Ser. No. 09/826,161 filed on Apr. 3, 2001 and now U.S. Pat. No. 6,477,933.

BACKGROUND OF THE INVENTION

1. Field of the Invention

The present invention relates generally to the field of electrical discharge weapons of the type which propel a pair of wire-tethered darts to impact a remote target. The invention herein relates more specifically to a wire-tethered dart cartridge which employs potential energy in the form of a coiled spring to impart kinetic energy to the darts to propel them toward a target.

2. Background Art

U.S. Pat. No. 3,803,463 discloses an apparatus for connecting a disabling electrical power supply to a remote animal target by means of dart(s) and trailing wire(s). A prior art reference in U.S. Pat. No. 5,654,867 describes the use of gases expanding from a pyrotechnic explosion to propel a pair of electrically opposed darts from such an electrical discharge weapon.

The most relevant prior art reference appears to be U.S. Pat. No. 5,078,117 which discloses the use of the sudden release of pressurized gas to propel a ballistic device. The sudden release of pressurized gas is effective in propelling ballistic devices over limited distances. Industry currently uses this claimed method of suddenly releasing pressurized gas to propel darts from an electrical discharge weapon. The use of such a propulsion technique in an electrical discharge weapon against a remote target, is beneficial because the weapon is not classified as a firearm. Thus, it may be used by civilians for self defense without restrictions and regulations that would otherwise be required by state or federal law if the weapon were classified as a firearm. Even though a pyrotechnic device is used to penetrate the container of the pressurized gas, because the ballistic devices (i.e., darts) are not propelled by the energy of the pyrotechnic device, the definition of a firearm is avoided under the various applicable laws.

Unfortunately, the use of the sudden release of a pressurized gas to propel wire-tethered darts does introduce certain unpredictable results. Principally, for a number of reasons, the accuracy and repeatability of the ballistic results imparted to the darts are less than would be desirable. One reason for this unpredictability is the method of releasing the gas. More specifically, a pyrotechnic device is electrically ignited to propel a pointed penetrator toward the container of the pressurized gas and rupture the container. The inexact nature of the ignition, the penetrator and the container, as well as the gas pressure itself, contribute to variation in the precise geometry of the rupture. As a result, the escaping gas does not follow a predictable path in exiting the container. The gas may therefore impact each of the two separate darts differently. Moreover, the gas flow is likely to be turbulent as pressure builds behind and around each dart, particularly as each dart exits the cartridge. All of these effects produce ballistic inaccuracy which makes it less likely that the darts will hit the intended target at all, let alone hit the target at specific locations where the electric discharge can be effective.

Thus, there is a need to find an alternative wire-tethered dart propulsion system which has the advantage of not being classified as a firearm, but which does not rely on sudden release of pressurized gas that is likely to diminish the accuracy of the weapon.

SUMMARY OF THE INVENTION

The present invention meets the aforementioned need by providing a dual wire-tethered dart cartridge for electrical discharge weapons wherein the sudden force needed to propel the darts toward a remote target is derived from a source of energy which does not rely on the use of a pressurized gas. While a pyrotechnic device is used to release the energy, like the prior art, the pyrotechnic-derived energy does not propel the darts. Therefore, the invention also provides the advantage of not being classified as a firearm under state and federal law. Furthermore, the propulsive force is derived from potential energy stored in at least one coiled spring having an arm which impacts the dart with sufficient force to propel the dart a desired distance toward a remote target. In a preferred embodiment disclosed herein, the spring is formed on two interconnected coils, each end of the spring wire extending from a respective coil and forming an impact arm for striking the back of the dart. The arms are maintained in a tensioned configuration by retention pistons each of which is connected to a pyrotechnic device. When an electrical voltage is applied to the pyrotechnic devices, the ignition forces the pistons to move to suddenly release the arms. The potential energy in the springs then forces the arms to rotate around their respective coils at high speed and impact the respective darts.

Because the invention does not require penetration of a pressurized gas container, the uncertainties of the gas container penetration and the gas flow turbulence are entirely avoided. Therefore, the transfer of energy from the spring to the darts is more predictable and repeatable and easier to adjust from cartridge to cartridge during manufacture. The result is a more accurate ballistic performance as compared to the prior art gas propelled system.

OBJECTS OF THE INVENTION

It is therefore a principal object of the present invention to provide a cartridge having wire-tethered darts for use in an electrical discharge weapon wherein the darts are propelled toward a remote target by the impact of an arm of a coiled spring released upon activation of the weapon.

It is another object of the invention to provide a gasless dart propulsion system in a cartridge having wire-tethered darts for use in an electrical discharge weapon.

It is yet another object of the invention to provide a propulsion system for wire-tethered darts in an electrical discharge weapon system wherein the darts are propelled by a spring instead of a sudden release of a pressurized gas from a penetrated container.

It is yet another object of the invention to provide an electrically activated cartridge for propelling darts toward a remote target in an electrical discharge weapon wherein pyrotechnic devices are employed to release tensioned spring arms to impact the darts to impart energy thereto.

BRIEF DESCRIPTION OF THE DRAWINGS

The aforementioned objects and advantages of the present invention, as well as additional objects and advantages thereof, will be more fully understood hereinafter as a result of a detailed description of a preferred embodiment when taken in conjunction with the following drawings in which.

DETAILED DESCRIPTION OF A PREFERRED EMBODIMENT

Figure 1:
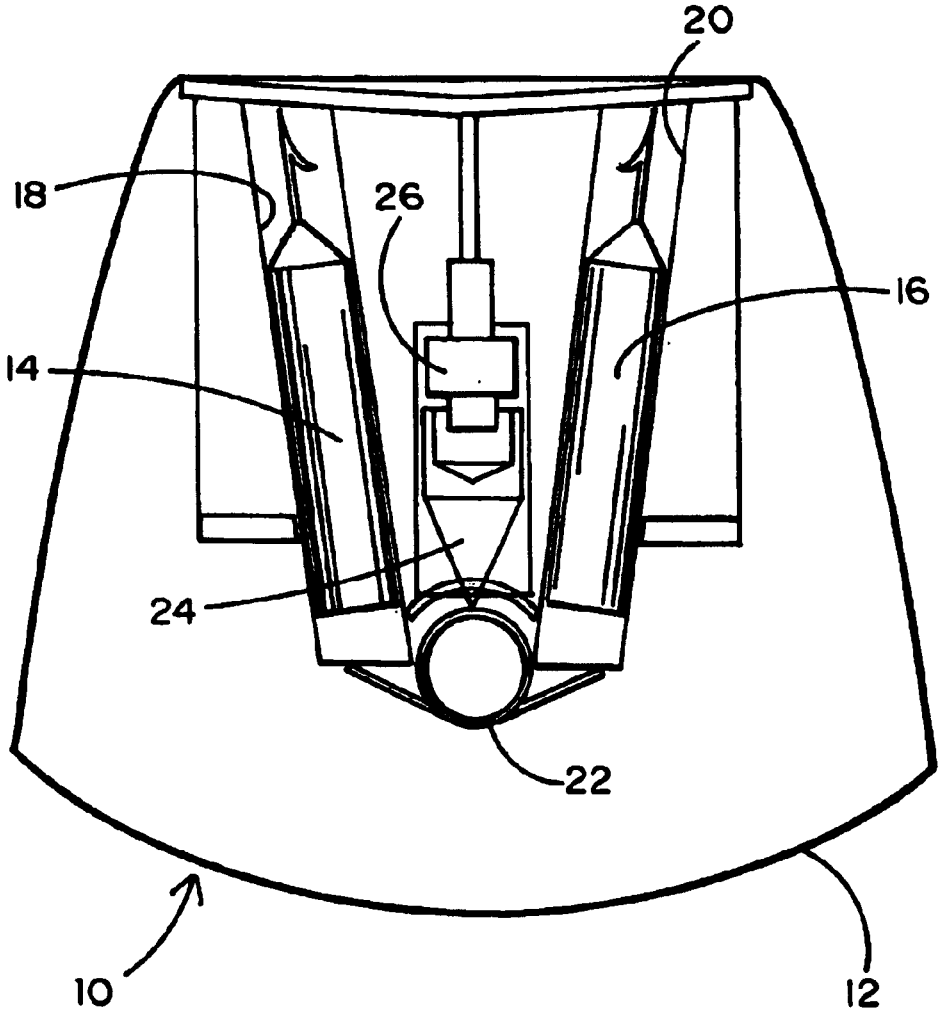
FIG. 1 (PRIOR ART)
FIG. 1 is a prior art drawing of a gas-based propulsion system.

Referring to the accompanying figures and FIG. 1 in particular, it will be seen that a prior art dart cartridge 10 comprises a housing 12, a pair of wire-tethered darts 14, 16, a pair of channels 18, 20, a gas container 22, a penetrator 24 and a pyrotechnic device 26. Darts 14, 16 are shown without their respective tether wires to avoid obfuscation of the structural features of this prior art device.

In operation of prior art cartridge 10, upon activation of the pyrotechnic device 26, the penetrator 24 is thrust into the container 22 creating a rupture in the wall of the container. Pressurized gas is suddenly released through the ruptured wall and is directed into channels 18, 20. The sudden increase in pressure in the channels behind darts 14, 16, propel the darts toward a target along respective paths out of housing 12. As previously described, the uncertainty of the wall penetration, rupture geometry and gas flow turbulence, all contribute to an unpredictable effect on the two darts. Moreover, because the gas flow is required to meander around the penetrator which is retained in the ruptured container, the direction of gas flow may affect the darts unequally, thereby further diminishing the ballistic characteristics of the weapon.

Moreover, the penetrator may crush the gas container sufficiently to allow room for the piston seal to exit its case. Hot gasses expanding from the pyrotechnic explosion within the case may then exit the case to further counter the already inefficiently directed force of the escaping pressurized gas. Also, any escape of hot propellant gases from the piston case necessitates redefining the weapon as firearm.

Figure 2:
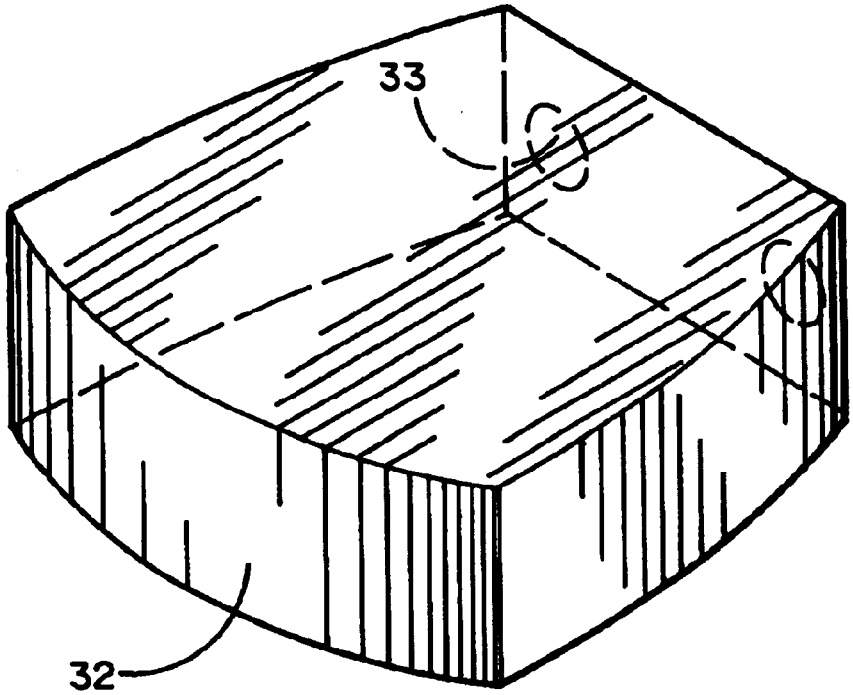
FIG. 2 is a three-dimensional view of the housing of a first embodiment of the cartridge.
Figure 3:
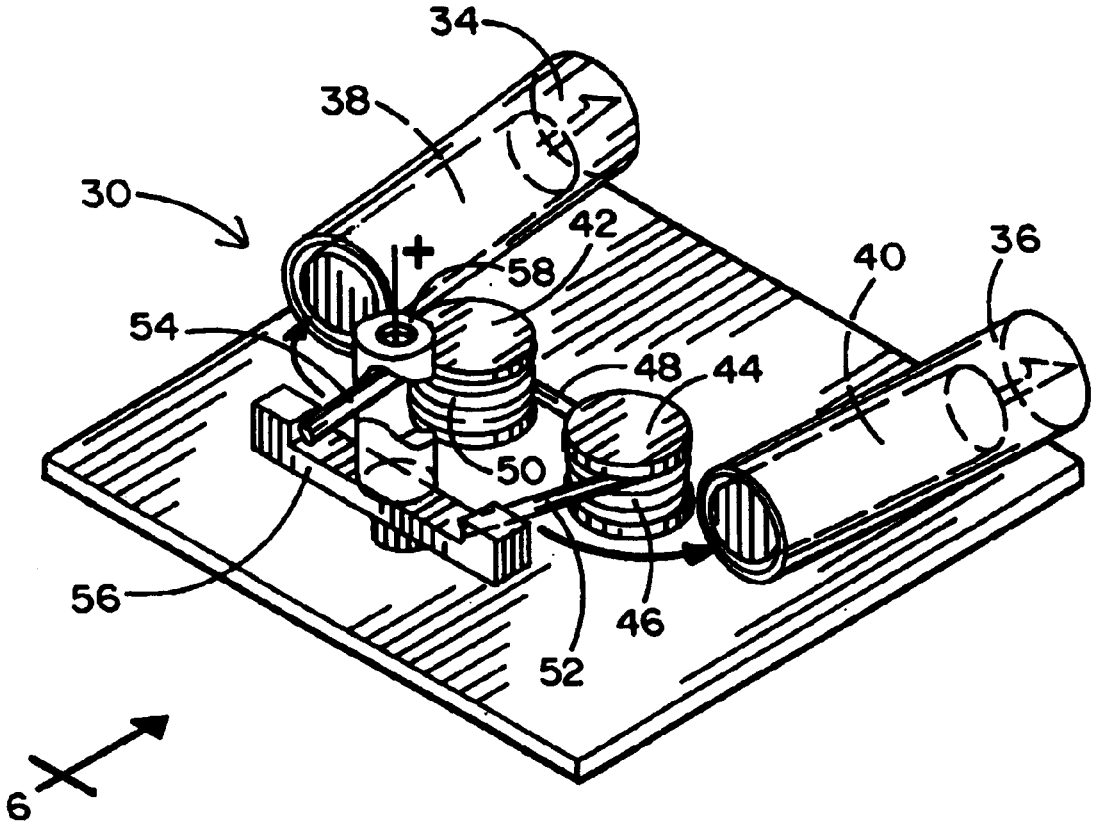
FIG. 3 is a three-dimensional view of the first embodiment of the invention.
Figure 5:
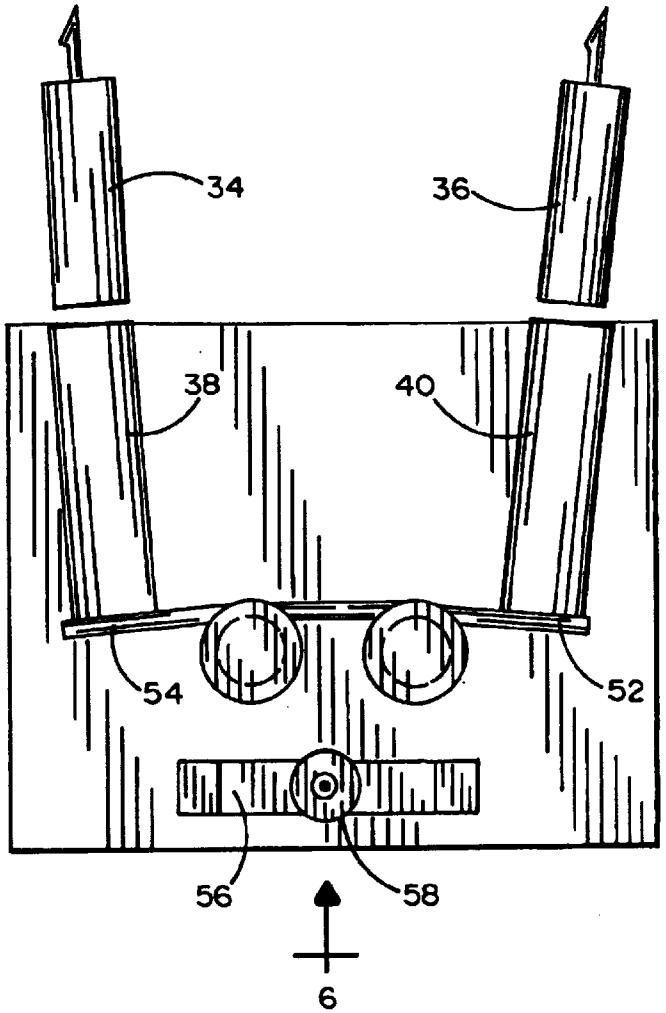
FIG. 5 is a top view of the first embodiment immediately following activation.
Figure 4:
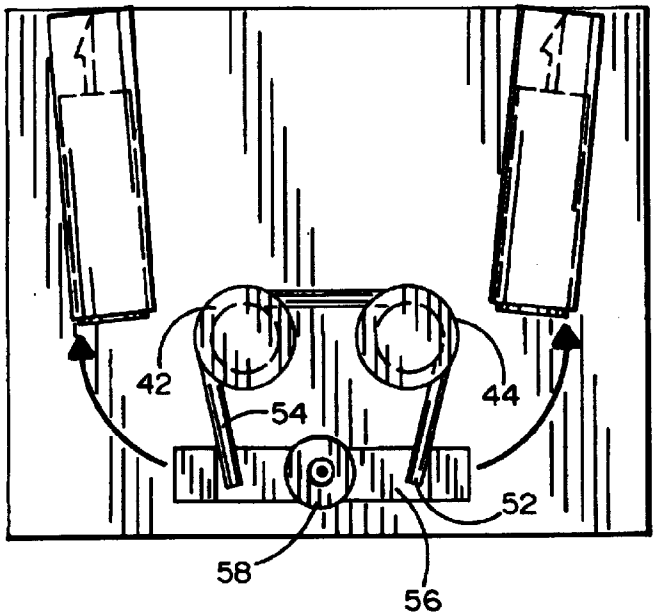
FIG. 4 is a top view of the first embodiment prior to activation.
Figure 6:
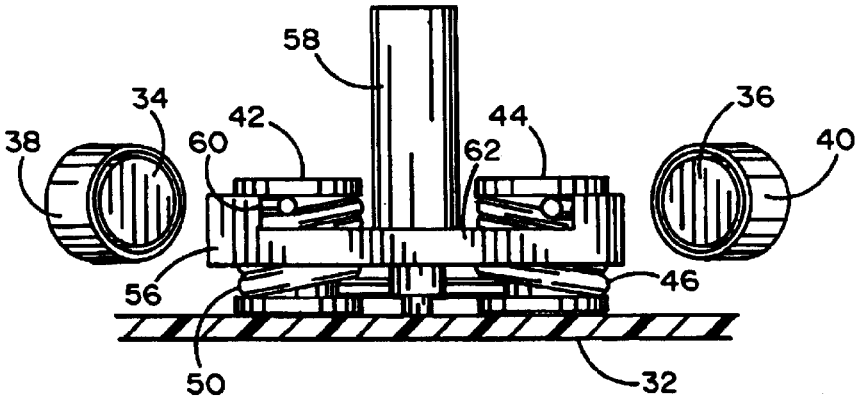
FIG. 6 is a side view of the first embodiment prior to activation.
Figure 7:
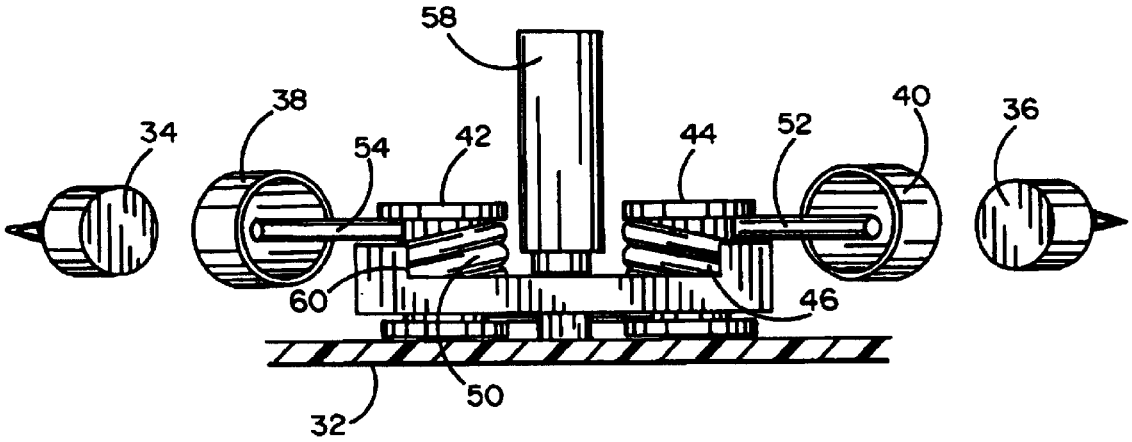
FIG. 7 is a side view of the first embodiment immediately following activation.

Further, to prevent resultant forces from dislodging the dart cartridge from the electrical discharge weapon upon activation of the pyrotechnic device 26, housing 12 must be attached to the weapon in a manner that directs the resultant forces against the weapon (not illustrated). This can create additional problems. To aim the weapon the operator might have to hold it in an unconventional and awkward manner. See FIGS. 1, 2 and 3 of prior art U.S. Pat. No. 5,786,546 to Simson, which prior art patent is incorporated herein by reference as though fully set forth herein. Also, the cartridge can only be designed for mounting on particular models of electrical discharge weapons. This is true even of prior art devices having more conventional pistol-type handgrips. See FIGS. 2 and 3, particularly probe 1, of prior art U.S. Pat. No. 6,360,645 to McNulty, which prior art patent is incorporated herein by reference as though fully set forth herein.

Additionally, to ignite pyrotechnic device 26, an electrical current from the electrical discharge weapon must travel through a circuit path (not otherwise illustrated) by arcing through the air gap between darts 14 and 16. In practice with such small concealable weapons, this requires that the gap between darts 14 and 16 is less than one inch. This, in turn, ultimately limits weapon range as described in prior art U.S. Pat. No. 5,831,199 to McNulty at column 3, lines 9–53, incorporated herein by reference.

Referring now to FIGS. 2–9, it will be seen that a first embodiment of the present invention comprises an entirely different form of an energy source that does not employ gas, or the sudden release of a pressurized gas from a sealed container, or the uncertainties of rupturing such a container, or the use of sudden increase in pressure behind the darts from inherently turbulent and unpredictable gas flow. Specifically, the invention herein relies instead on the use of energy stored in coiled springs and the transfer of energy to the darts by impacting the back end of each dart with a spring arm that is released upon activation of the weapon.

As seen in FIGS. 2–9, in accordance with a preferred embodiment, a dart cartridge 30 comprises a housing 32 having dart exit apertures 33, channels 34, 36 and darts 38, 40. The housing apertures, channels and darts of the illustrated embodiment are substantially unchanged from the prior art cartridge of FIG. 1. The energy source of the preferred embodiment comprises a pair of spools 42, 44 around which are wound respective spring coils 46 and 50 which are formed from a unitary length of spring steel 48. The free ends of the coils 46 and 50 form the impact spring arms 52, 54 which, upon activation of the weapon in which cartridge 30 is used, will impact and propel the darts 38, 40. The arms 52, 54 are secured in their inactivated, tensioned configuration by a retention bracket 56 which has a pair of opposed end walls 60 forming a recess 62 between them. Arms 52, 54 reside in recess 62 secured by respective end walls 60.

Figure 9:
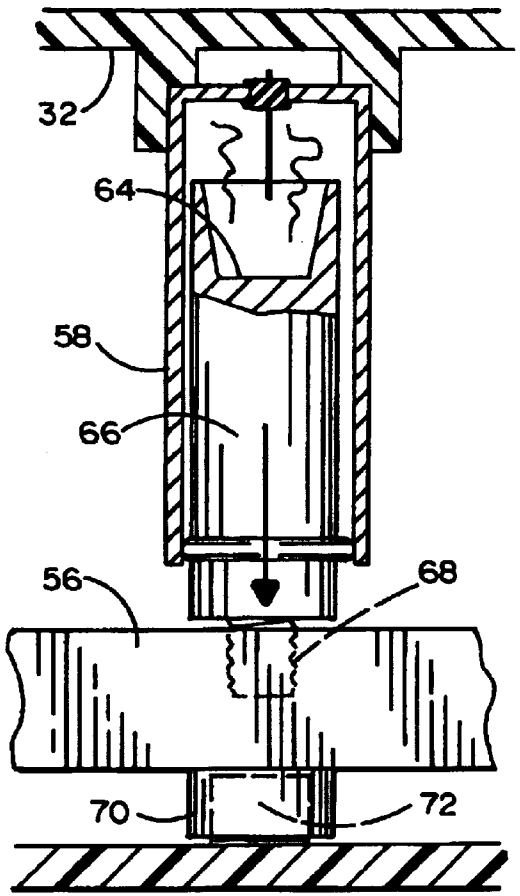
FIG. 9 is a view similar to FIG. 8, but showing the pyrotechnic device immediately after activation.
Figure 8:
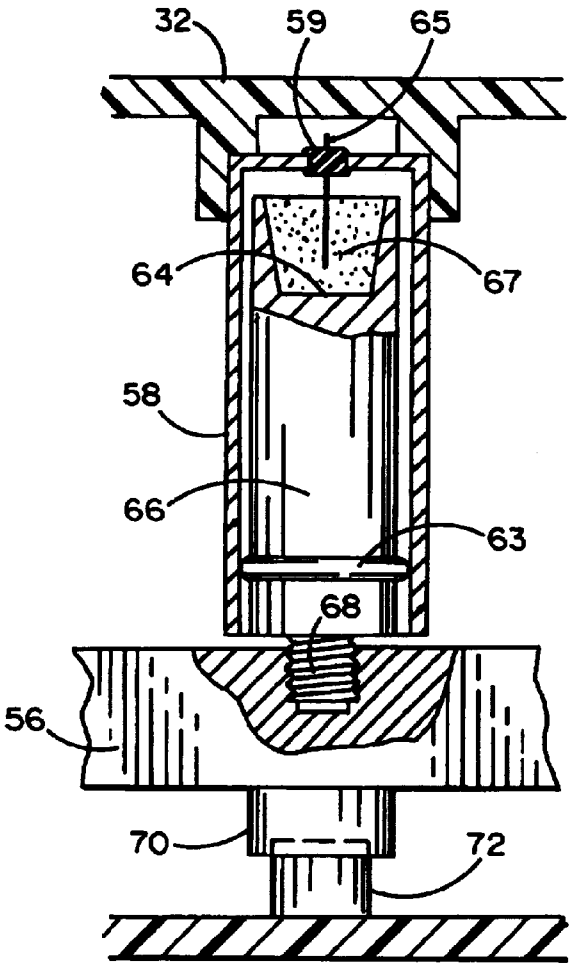
FIG. 8 is an enlarged partially cross-sectioned side view of the pyrotechnic portion of the first embodiment prior to activation.
Figure 10:
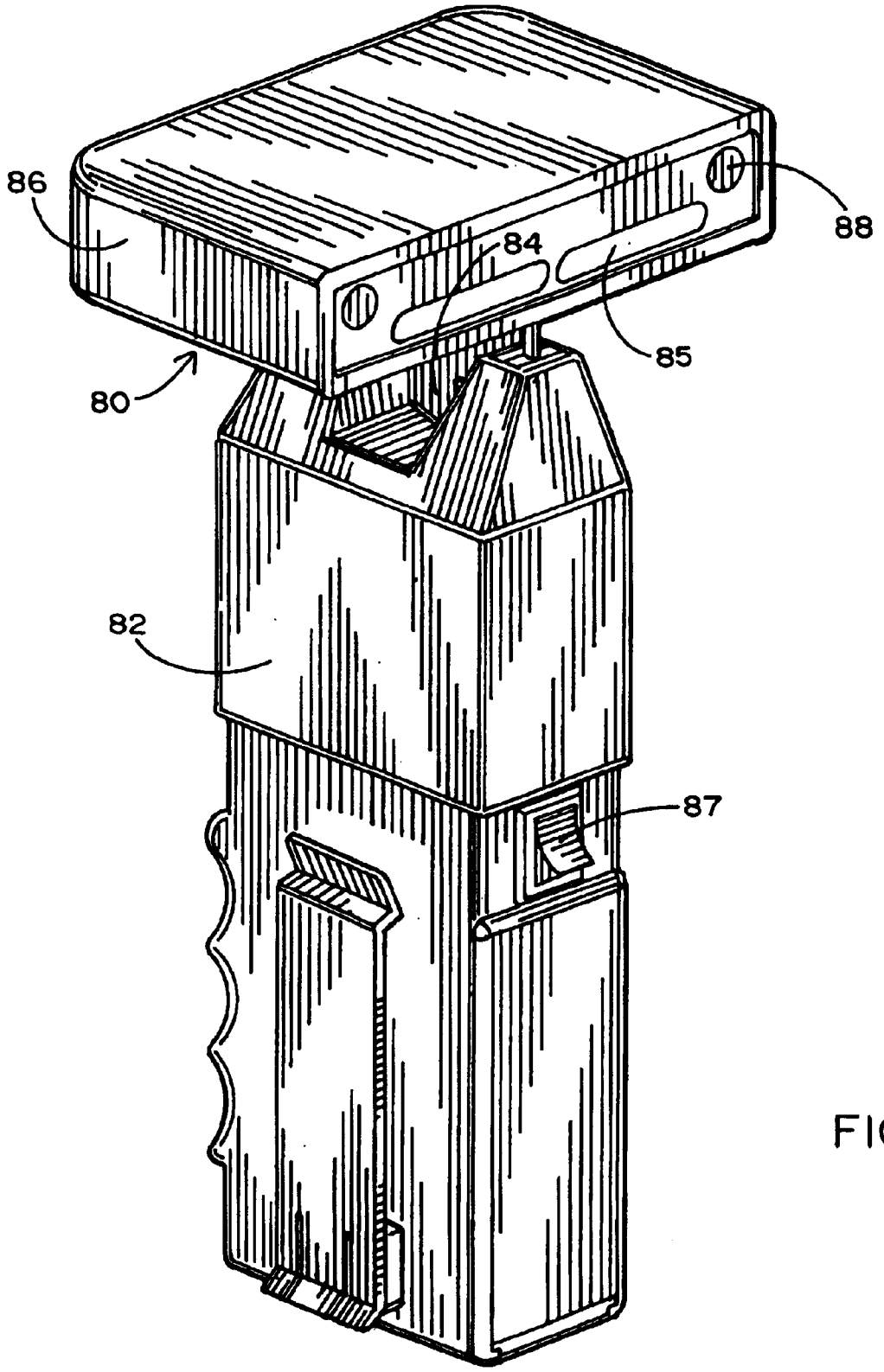
FIG. 10 is a three-dimensional view of a second embodiment of the invention shown connected to an electrical discharge weapon.
Figure 11:
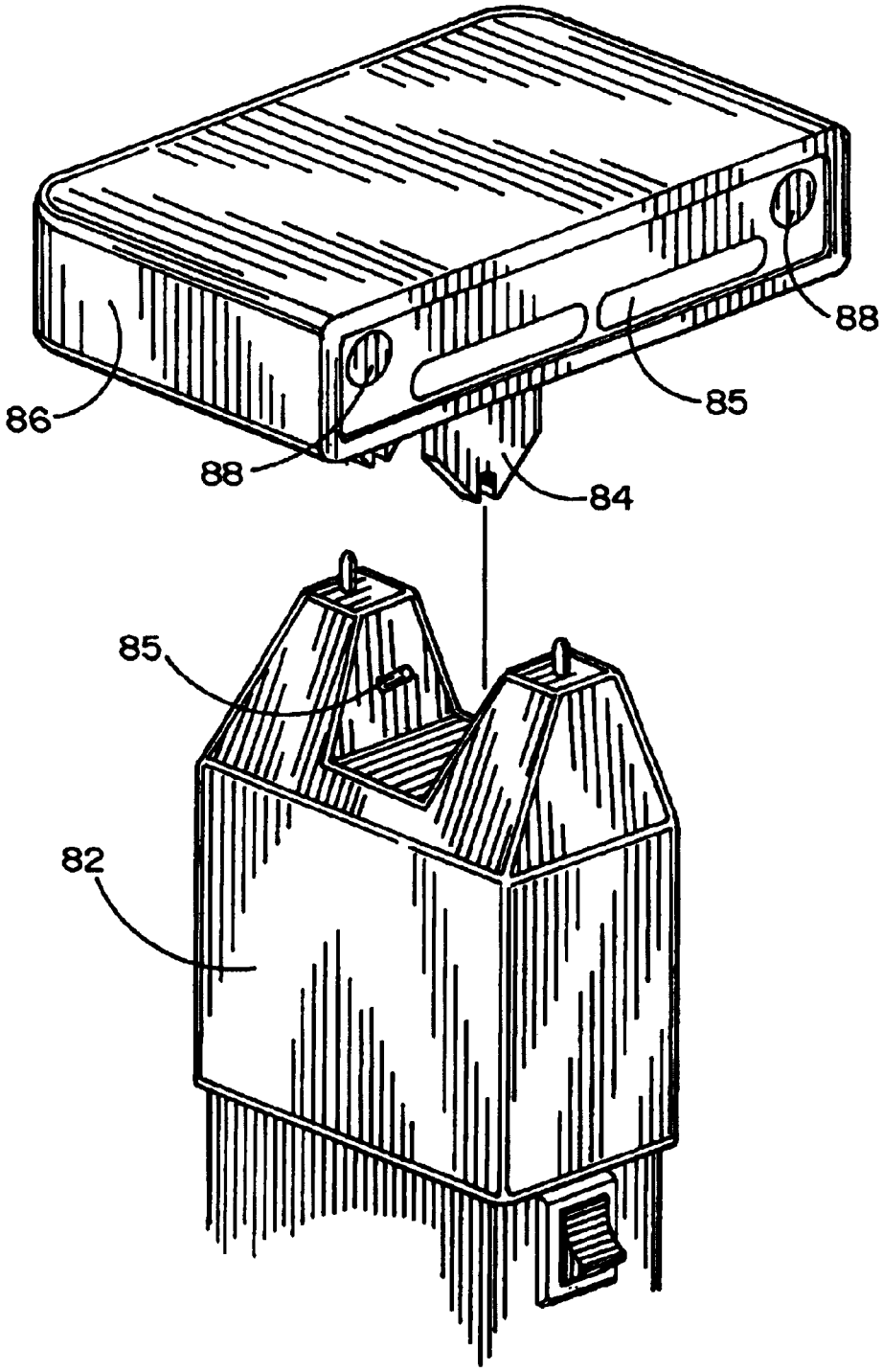
FIG. 11 is an exploded view of the embodiment and weapon of FIG. 10.
Figure 12:
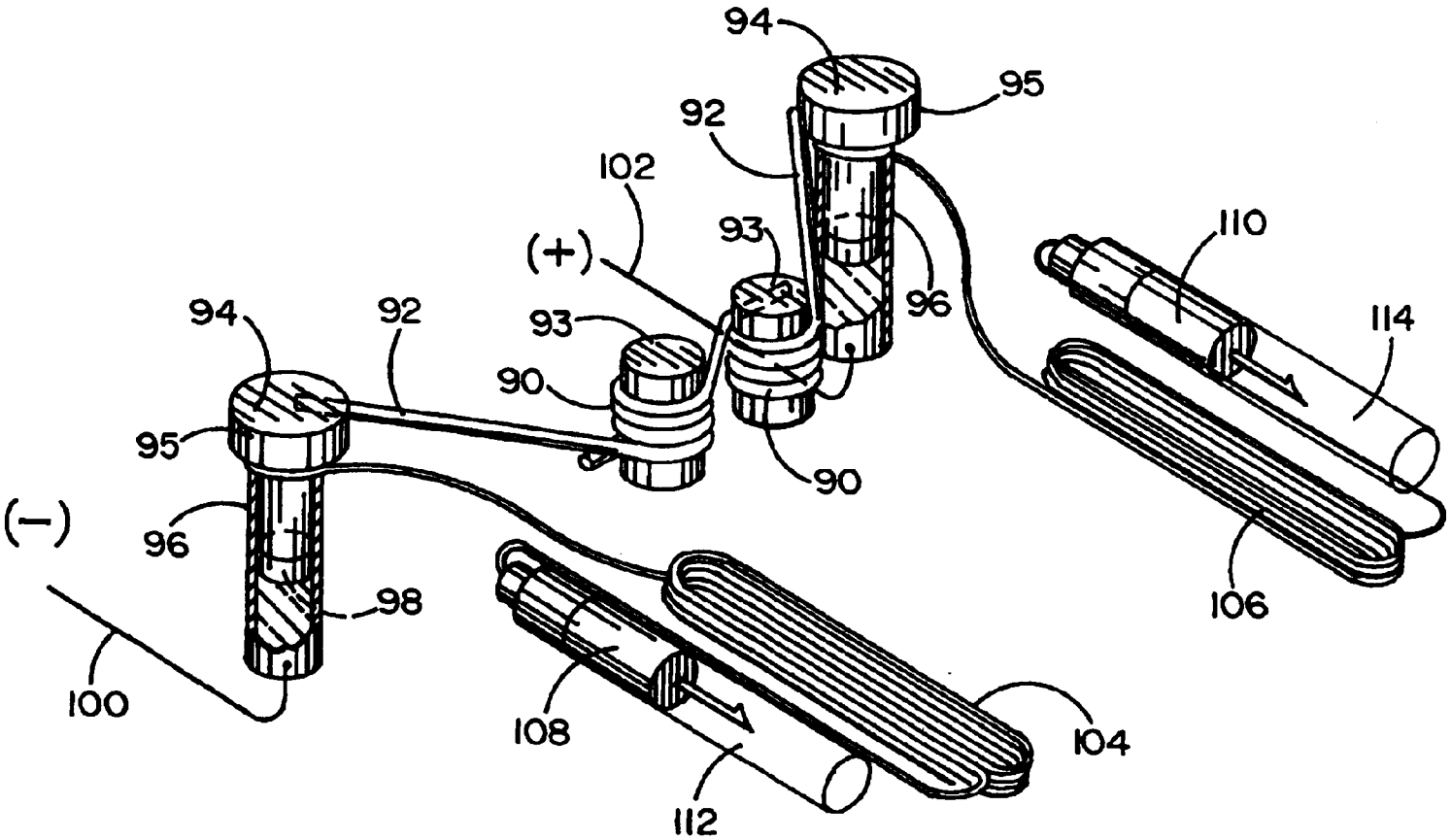
FIG. 12 is a view of the interior components of the second embodiment shown prior to dart propulsion.

The activation mechanism for selectively releasing arms 52, 54 to impact the darts 38, 40, is best shown in FIGS. 8 and 9. Specifically, a pyrotechnic device 58 comprises a combustion cup 64 holding a combustible (i.e., gun powder) 67 into which an ignition wire 65 extends after passing through an insulator 59. Cup 64 is formed in an end of a piston 66 having a ring 63. The other end of piston 66 has a threaded member 68 extending into retention bracket 56. As shown in FIGS. 8 and 9, ignition of the device 58 drives the piston 66 down thereby translating bracket 56. A cylinder 70 and guide 72, assure smooth linear translation of the bracket. Bracket 56 is moved downwardly a sufficient distance to prevent walls 60 from securing spring arms 52, 54. Consequently, upon activation of the pyrotechnic device 58, the sudden translation of bracket 56 releases arms 52, 54 which rapidly swing through respective paths striking the darts 38, 40. The spring constant and the degree of tensioning are selected to provide a desired impact force to achieve a sufficient transfer of momentum to the darts to propel them toward the target over the required distance. Use of a unitary length of spring steel 48 improves the probability of equal energy transfer to both darts and use of a single retention bracket translated by activation of a single pyrotechnic device improves the probability of simultaneous energy transfer to both darts. Moreover, the precise geometry of the spring and the coils, increases the probability of predictable and repeatable results (i.e., ballistic performance of the darts) from one cartridge to the next. Thus, it will be seen that the illustrated first embodiment of the invention appears to meet the aforementioned objects of the present invention.

A second embodiment 80 is illustrated in FIGS. 10–15. This embodiment is specifically configured to be attached to a close proximity target electrical discharge weapon 82 by means of a pair of clip-on brackets 84 which mate with over-voltage discharge electrodes 83 of weapon 82. Embodiment 80 comprises a housing 86 having a pair of wire bays 85 and a pair of dart apertures 88.

Inside housing 86, the embodiment 80 comprises a pair of interconnected spring coils 90 each terminating in a spring arm 92 and each positioned on a respective post 93. Arms 93 are retained by heads 95 of respective pistons 94 which also comprise respective shafts 97 positioned in retainer channels 96 with respective pyrotechnic actuators 98. As shown best in FIG. 15, a chamber 99 above each piston 93, permits translation of the heads 95 above the arms 92 upon activation of the actuators 98 to release the arms to impact the darts 108 and 110, which reside in respective dart channels 112 and 114. Following detonation of the actuators, resultant forces are directed to clip-on brackets 84 and over-voltage electrodes 83, where the brackets and electrodes attach. The air gap between electrodes 83 is near uniform for various models of electrical discharge weapons, allowing for near universal fitting of the cartridge to such weapons. Still, the weapon has a conventional pistol-type hand grip for easy aiming.

Figure 13:
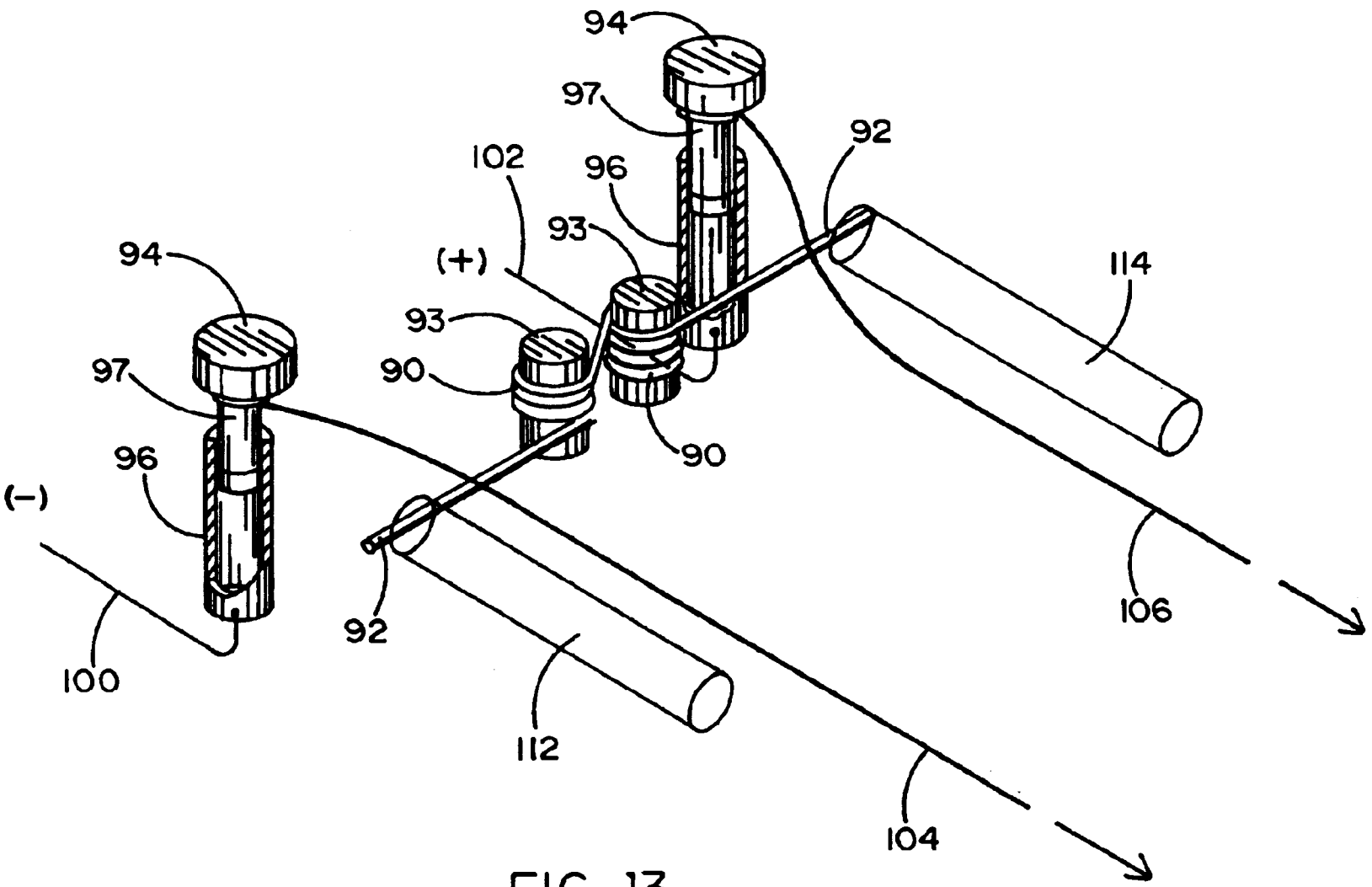
FIG. 13 is a view similar to that of FIG. 12 but shown after dart propulsion.
Figure 14:
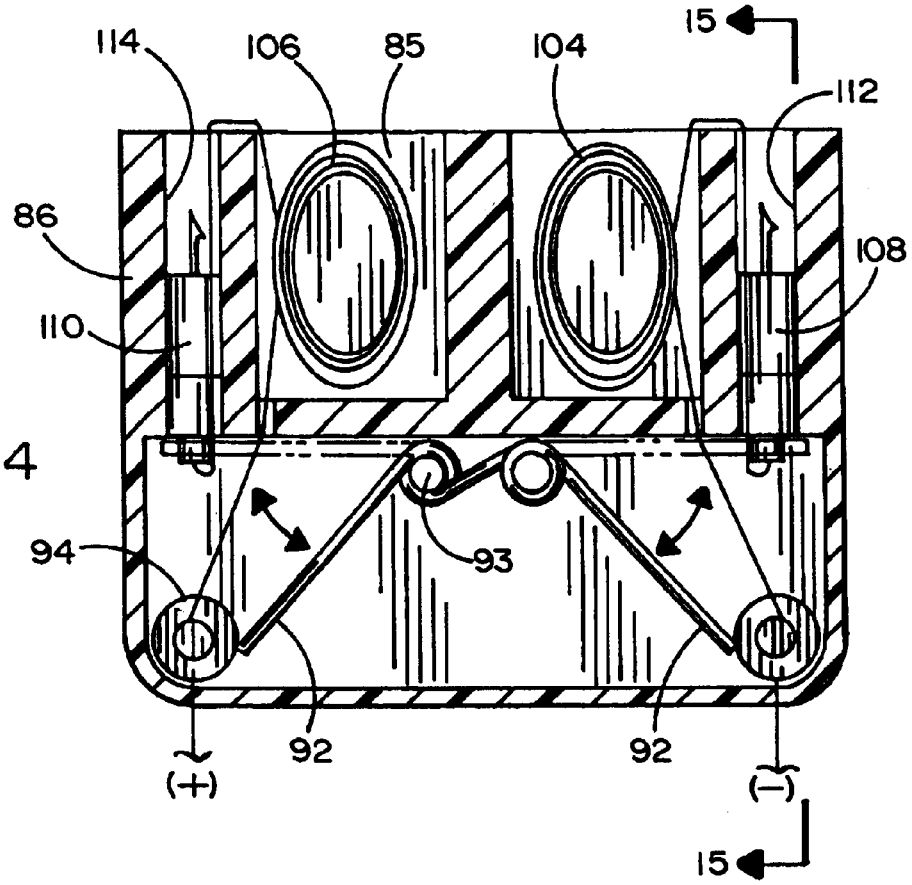
FIG. 14 is a cross-sectional view of the second embodiment.
Figure 15:
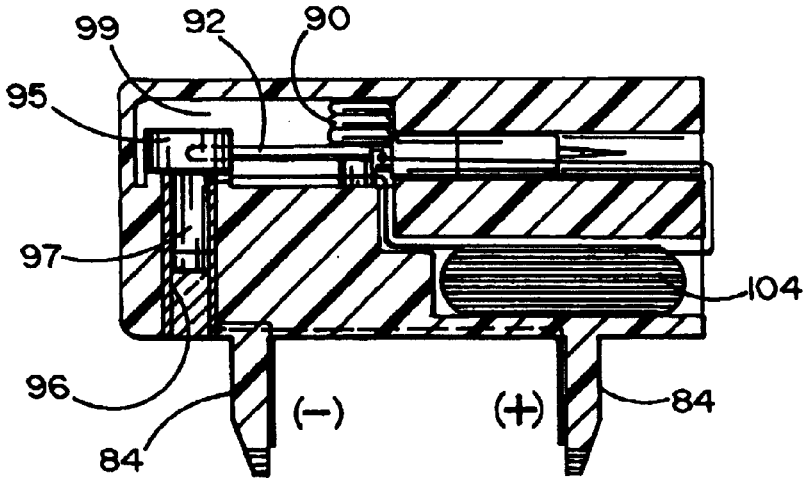
FIG. 15 is a cross-sectional view taken along lines 15—15 of FIG. 14.

Clip-on brackets 84 (see FIG. 11) are connected to actuators 98 by wires 100 (–) and 102 (+) so that activation of weapon 82 by a switch 87 applies a high voltage pulsed signal to wires 100, 102. Current travels through the actuators 98, spring arms 92 and coils 90 which form a complete circuit which translates the two pistons substantially simultaneously. Once the spring arms are released, this circuit is opened because the spring arms are no longer in contact with the pistons. The gap openings allow for a longer clothing penetrating arc at the target than with prior art devices. Wire-tethered darts 108,110 are connected to bundled wires 104, 106, respectively. These wires are, in turn, connected to piston shafts 97. Therefore, the darts 108, 110 are also connected to wires 100, 102 through the conductive pistons 95. Once the spring arms 92 are released, the aforementioned activation circuit is opened and when the darts 108, 110 strike a remote target, a new circuit through the target is formed to disable the target. Bundled wires 104, 106 reside in wire bays 85 until the propelled darts 108, 110 pull the wires along their respective trajectories as shown in FIG. 13. In this embodiment, the darts 108 and 110 may exit housing 86 at a distance from each other sufficient to disable a human target completing the active circuit path.

Having the benefit of the disclosure of the preferred embodiments, those having ordinary skill in the relevant art, will now perceive various modifications and additions which may be made to that embodiment. By way of example, the precise geometry of the spring coils as well as their position relative to the darts and even the implementation of retention and release of the spring arms, may be readily altered while still achieving the desired results. Accordingly, the invention is not limited by the disclosed exemplary embodiments, but only by the appended claims and their equivalents.

What is claimed is:

1. A dart propulsion apparatus for use in an electrical discharge weapon;

the apparatus comprising:

a coiled spring having a free end configured as an impact arm for striking a dart;

a retention piston securing said arm in a tensioned state; and a pyrotechnic device adjacent to said retention piston and responsive to activation of said weapon to translate said retention piston away from said impact arm to permit said arm to strike said dart and propel said dart from said weapon.

2. The apparatus recited in claim 1 wherein said retention piston comprises a head and a shaft and wherein said head is of sufficient size to secure said arm until activation of said weapon.

3. The apparatus recited in claim 2 wherein said shaft of said retention piston is of smaller size than said head whereby translation of said piston releases said arm.

4. The apparatus recited in claim 1 further comprising a spool positioned at a selected location relative to said dart, and wherein said coiled spring is installed on said spool.

5. The apparatus recited in claim 1 further comprising a housing enclosing said apparatus and having at least one channel in which said dart is positioned prior to being propelled by said impact arm, said housing having an aperture aligned with said channel to permit said dart to exit said housing after being struck by said impact arm.

6. A dart propulsion apparatus for use in an electrical discharge weapon;

the apparatus comprising:

a spring in a tensioned energy storing configuration and positioned in proximity to a dart;

a piston nominally preventing said spring from being released; and a pyrotechnic device which upon ignition moves said piston to release said spring to transfer said energy to said dart.

* * * * *